US005981125A

United States Patent [19]

Itami

[11] Patent Number: 5,981,125

[45] Date of Patent: Nov. 9, 1999

[54] ELECTROPHOTOGRAPHIC PHOTORECEPTOR, AND AN IMAGE-FORMING APPARATUS AND METHOD OF USING THE SAME

[75] Inventor: Akihiko Itami, Hachioji, Japan

[73] Assignee: Konica Corporation, Tokyo, Japan

[21] Appl. No.: 09/040,010

[22] Filed: Mar. 17, 1998

[30] Foreign Application Priority Data

Mar. 24, 1997 [JP] Japan ..... 9-069406

[51] Int. Cl.[6] ..... G03G 5/043; G03G 5/047

[52] U.S. Cl. ..... 430/56; 430/58.05; 430/59.5; 430/78; 430/134; 399/159

[58] Field of Search ..... 430/78, 56, 134, 430/59.5, 58.05; 399/159

[56] References Cited

U.S. PATENT DOCUMENTS 5,354,635 10/1994 Itami et al. ..... 430/78
5,521,047 5/1996 Yuh et al. ..... 430/134
5,834,149 11/1998 Tambo et al. ..... 430/78

FOREIGN PATENT DOCUMENTS 4-338759 11/1992 Japan .

OTHER PUBLICATIONS

Chemical Abstracts 118:222835.

*Primary Examiner*—Christopher D. Rodee
*Attorney, Agent, or Firm*—Frishauf, Holtz, Goodman, Langer & Chick, P.C.

[57] ABSTRACT

An electrophotographic photoreceptor is disclosed. It comprises a photosensitive layer on an electrically conductive support and the photosensitive layer contains at least one compound of 0.001 to 10 weight percent selected from dioxolan and dioxolan derivatives, and titanylphthalocyanine or titanylphthalocyanine/vanadylphthalocyanine mixed crystal.

17 Claims, 7 Drawing Sheets

ELECTROPHOTOGRAPHIC PHOTORECEPTOR, AND AN IMAGE-FORMING APPARATUS AND METHOD OF USING THE SAME

FIELD OF THE INVENTION

The present invention relates to an electrophotographic photoreceptor and an image-forming apparatus and method of using the same.

BACKGROUND OF THE INVENTION

In recent years, research and development have increasingly been conducted on electrophotographic photoreceptors having a photosensitive layer comprising a variety of organic photoconductive compounds as the main component. Particularly, a number of investigations have been carried out on the function-separating type photoreceptors in which a charge generation function and a charge transport function are shared with different materials, respectively, because each of the materials may be selected from a wide range of materials, and photoreceptors having optional performance can rather readily be prepared and many of them have been put into practical use.

These photoreceptors are manufactured by coating, on an electrically conductive support in the layered structure, compounds having the charge generating function and the charge transport function. Accordingly, the photoreceptor has generally a multilayer structure, and a coating composition, prepared by dissolving solid compounds in a solvent, is coated in the presence of the solvent.

Many organic solvents, having high dissolving power and an appropriate boiling point, particularly suitable for industrial use are, harmful. Solvents having excellent properties such as, for example, halogen based solvents exhibit a more adverse trend.

Solvents are employed for the production of the photoreceptors. Therefore, they cannot be employed if they possess neither good dissolving power nor appropriate boiling point, or if they adversely affect characteristics required for the electrophotographic photoreceptor. Thus, a solvent which meets all these requirements is urgently needed.

Titanylphthalocyanine having a maximum peak at 27.2°±0.2° of Bragg 2θ for Cu—Kα line contains several water molecules per titanylphthalocyanine molecule in the crystal. These water molecules assist the dissociation process of the ion pair formed from the excited state of S1 in the course of the generation of a carrier to a free carrier with borrowing an electric field force. Accordingly, it has been known that in this crystal, a high quantum yield is obtained which is not found in the other crystal form. (Kinoshita, Summaries of Electrophotographic Society Third Technical Course, page 22, 1991) Therefore, in order to consistently take out the characteristics of titanylphthalocyanine having a maximum peak at 27.2°±0.2° of Bragg 2θ for Cu—Kα line, it is important that water molecules are capable of being abundantly present in the crystal. Due to this, there has been a problem of great variation in sensitivity under environments of low temperature and humidity, which reduce water content in the photoreceptor upon drying. In order to solve this problem, conventionally, a moisture maintaining technique has been investigated in which diol is incorporated in a carrier generating layer. However, when a compound comprising an OH group having high polarity, such as diol, is abundantly present in the photosensitive layer, there have been associated problems in which variation in electric potential is large during usage and no sufficient durability is obtained.

SUMMARY OF THE INVENTION

An object of the present invention is to provide a photoreceptor which is prepared by employing a coating solvent which comprises no halogen atoms; is low in toxicity; causes no environmental problems, particularly the ozone hole problem and carcinogenic problems; is excellent at multilayer coating properties; which exhibits particularly small variations in sensitivity over long-term use from the initial image formation; is excellent in the electric potential properties and image characteristics; an image-forming apparatus and method of using the same.

The photoreceptor of the present invention comprises a photosensitive layer on a support. The photosensitive layer contains at least one compound of 0.001 to 10 weight percent selected from dioxolan and dioxolan derivatives, and a photosensitive material comprising titanylphthalocyanine or titanylphthalocyanine/vanadylphthalocyanine mixed crystal.

In an embodiment of the electrophotographic photoreceptor the photosensitive material is titanylphthalocyanine.

The titanylphthalocyanine has preferably a maximum peak at 27.2°±0.2° of Bragg 2θ for Cu—Kα line. In another preferable embodiment, the titanylphthalocyanine has a maximum peak at 27.2°±0.2θ and a peak at 9.5°±0.2° of Bragg 2θ for Cu—Kα line.

The content of the dioxolan or dioxolan derivatives is preferably from 0.1 to 5 weight percent.

In an embodiment of the electrophotographic photoreceptor the photosensitive material is a titanylphthalocyanine/vanadylphthalocyanine mixed crystal.

The titanylphthalocyanine/vanadylphthalocyanine mixed crystal has preferably a maximum peak at 27.2°±0.2° of Bragg 2θ for Cu—Kα line. In another preferable embodiment, the titanylphthalocyanine/vanadylphthalocyanine mixed crystal has a maximum peak at 27.2°±0.2° and a peak at 9.5°±0.2° of Bragg 2θ for Cu—Kα line. In the other preferable embodiment, the titanylphthalocyanine/vanadylphthalocyanine mixed crystal has a maximum peak at 27.2±0.2° and a peak at 9.0°±0.2° of Bragg 2θ for Cu—Kα line.

The electrophotographic photoreceptor of the invention is suitably employed in an image-forming apparatus comprising at least each means of charging, image exposure, development, transfer, separation, and cleaning, and employed for forming images on plurality of sheets, an image-forming apparatus.

DETAILED DESCRIPTION OF THE INVENTION

Figure 1:
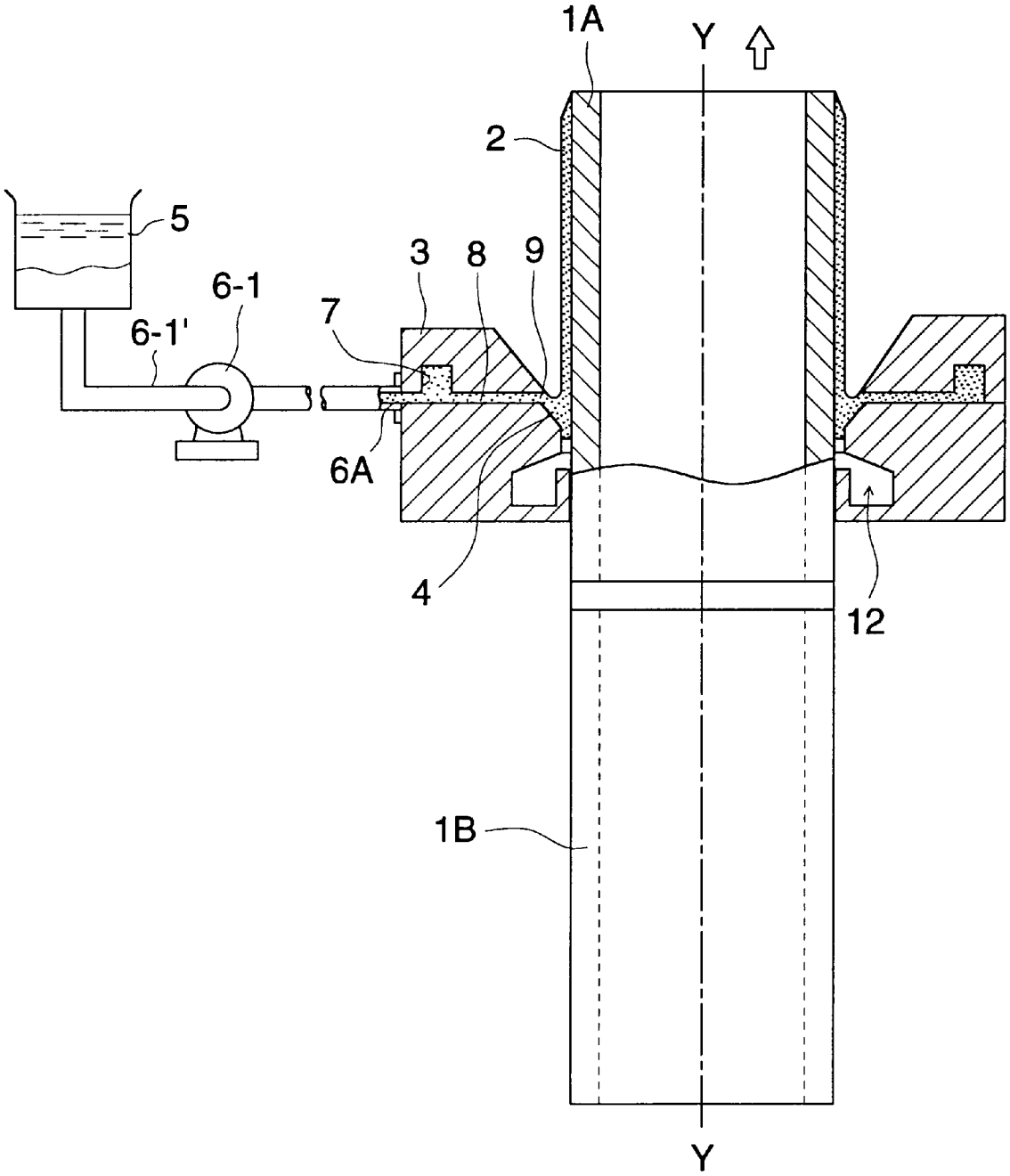
FIG. 1 is a schematic sectional view of a coating apparatus employed in the present invention.

Titanylphthalocyanine employed as a carrier generating material (CGM) in a photoreceptor comprises several water molecules per titanylphthalocyanine molecule. These water molecules assist the dissociation process of the ion pair formed from the excited state of S1 in the course of the generation of a carrier to a free carrier with borrowing an electric field force. Accordingly, it has been known that in this crystal, the high quantum yield is obtained which is not found in the other crystal forms. Particularly, in order to consistently take advantage of the characteristics of titanylphthalocyanine having a maximum peak at 27.2°±0.2° of Bragg 2θ for Cu—Kα line, it is important that water molecules are abundantly present in the crystal. Conventionally, a moisture maintaining technique has been investigated in which diol is incorporated in a carrier generating layer. However, when a compound comprising an OH group having high polarity such as diol is abundantly present in the photosensitive layer, there have been problems in which the variation in electric potential is large during usage and no sufficient durability is obtained.

The inventors of the present invention have found that when an optimum amount of a dioxolan compound is incorporated in a photosensitive layer, the dependence on the environment is improved and the variation in the electric potential during repeated use is minimized, as seen in the addition of diol.

When the content of a dioxolan compound in the photosensitive layer is from 0.001 to 10 weight percent, the variation in the electric potential is improved and the preferred electric potential can be maintained. Thus, the sufficient effect can be obtained.

The content of a dioxolan compound in the photoreceptor is dependent on drying temperature, drying time, drying air speed, air volume, etc.

The amount of a dioxolan compound is dependent mainly on its type and drying temperature after forming the layer. The drying temperature is generally between 80 and 150° C. and preferably between 90 and 118° C.

The content of a dioxolan compound incorporated in the photoreceptor can be quantitatively analyzed with methods well known to those skilled in the art, for example, gas chromatography, etc.

As for the electrophotographic photoreceptor, particularly an organic photoreceptor, in the formation of the photosensitive layer and the like, the best manufacturing method is that in which compounds composing the photosensitive layer are dissolved in a solvent, followed by coating the resulting composition.

Conventionally, however, coating solvents which have been widely employed to prepare the electrophotographic photosensitive layer are halogen atom-containing organic solvents such as methylene chloride, ethylene chloride, chloroform, monochlorobenzene, etc. In view of environmental problems and carcinogenicity, these solvents are now being increasing prohibited for such use.

As solvents having no halogen atoms, there have been employed toluene, tetrahydrofuran (THF), dioxane, methyl ethyl ketone (MEK), cyclohexane, etc. However, the problems have not been solved in which due to the insufficient dissolving power for coating materials such as charge transport materials, etc. an increase in viscosity is caused; due to the difficulty in preparing a high-concentrated coating composition, the intended thickness of a coating layer cannot be realized. Particularly, thickness of the charge transport layer is preferably 12 μm or more. In cases in which, for example, polycarbonate is used as a binder, the coating composition is preferably to have a high concentration of at least 5 weight percent, preferably at least 8 weight percent, and a viscosity of 300 cp (at 22° C.) or less. However, such properties cannot yet be obtained, if the above-mentioned solvents comprising no halogen atoms are employed. Accordingly, it is occasionally required to perform 2- or 3-step coating.

Further, as mentioned below, polycarbonate is frequently applied to the electrophotographic photoreceptor as an excellent binder. As a good solvent for the polycarbonate, there is dioxane forming cycled ether comprising 2 oxygen atoms in the molecule. However, the dioxane exhibits strong toxicity and carcinogenicity, and thus cannot be applied to production processes.

Dioxolan compounds can be employed for this compound as the solvent. When a suitable amount of the dioxolan compound is incorporated in a photosensitive layer, excellent advantages are exhibited.

Dioxolan compounds are 5-membered cyclic ether compounds which comprise a dioxolan nucleus comprising 2 oxygen atoms which do not adjoin each other in the molecule. Dioxolan compounds may be employed which have a dioxolan nucleus in the molecular structure; can dissolve a binder and other additives employed for the photosensitive layer, and can be dried when the photosensitive layer is manufactured. Those having a boiling point of 200° C. or less are preferably employed.

Dioxolan compounds represented by the following general formula (1) are preferably employed.

Formula (1)

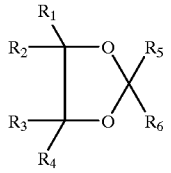

Wherein $R_1$ to $R_6$ each independently represents a hydrogen atom or a substituted or unsubstituted alkyl group. At least 2 groups of $R_5$ and $R_6$ or $R_1$ to $R_4$ may join to form a ring. $R_1$ to $R_6$ each independently preferably represents a hydrogen atom or an alkyl group having 1 to 6 carbon atoms, and preferably 1 to 4 carbon atoms.

Substituents of the alkyl group may be optional. However, preferably there are listed groups having 1 to 4 carbon atoms such as an alkoxy group, an acyl group, an acyloxy group, or a hydroxyl group. Rings which are formed by joining at least 2 groups of $R_5$ and $R_6$ or $R_1$ to $R_4$ are optional. However, preferably listed are 5- to 6-membered aromatic rings (for example, benzene ring) or non-aromatic rings (for example, cyclohexane ring).

Of these, compounds in which at least one of $R_5$ and $R_6$ is a hydrogen atom, or both of $R_1$ and $R_3$ are hydrogen atoms, are preferred, and those in which all of $R_1$ to $R_6$ are hydrogen atoms are particularly preferred.

Furthermore, the boiling point of the compound of the present invention is preferably between 74 and 200° C. under normal pressure. Those having a boiling point of 150° C. or less are more preferred and those having a boiling point between 74 and 130° C. are particularly preferred. The dioxolan compound having a boiling point in this range is employed as a solvent for the photosensitive layer, and the desired amount may be incorporated in the photosensitive layer by employing suitably selected drying conditions. Once dried, the content of the dioxolan compound in the photosensitive layer does not substantially vary.

Examples of dioxolan compounds preferably employed in the present invention are illustrated below.

No. 1

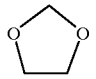

bp.74–75 °C.

No. 2

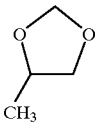

bp.80–83 °C.

No. 3

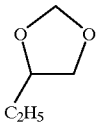

bp.109 °C.

No. 4

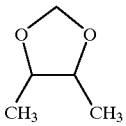

bp.98–100 °C.

No. 5

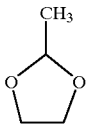

bp.81–82 °C.

No. 6

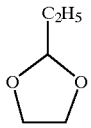

bp.106–107 °C.

No. 7

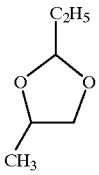

bp.113–115 °C.

-continued

No. 8

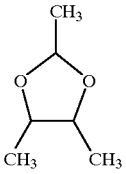

bp.107 °C.

No. 9

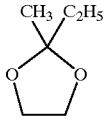

bp.112–113 °C.

No. 10

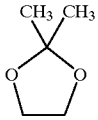

bp.92–93 °C.

No. 11

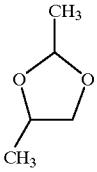

bp.92–93 °C.

No. 12

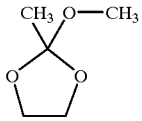

bp.118 °C.

No. 13

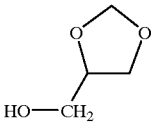

bp.195 °C.

No. 14

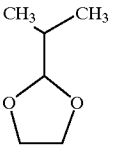

bp.122–123 °C.

No. 15

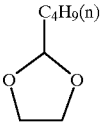

bp.162–163 °C.

-continued

No. 16

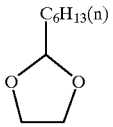

bp.200 °C.

No. 17

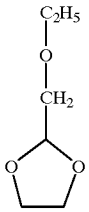

bp.165–166 °C.

No. 18

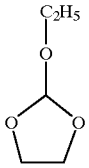

bp.143 °C.

No. 19

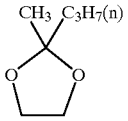

bp.141 °C.

No.20

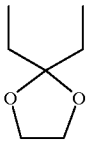

bp.171 °C.

No.21

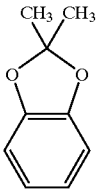

bp.182 °C.

No.22

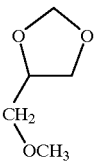

bp.115 °C.

-continued

No.23

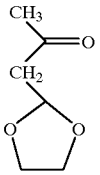

bp.148 °C.

No.24

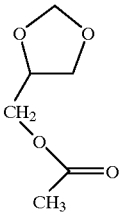

bp.155 °C.

The photosensitive layer is a layer displaying photosensitivity. The photosensitive layer is composed of a single layer or a plurality of layers. The multilayer type designates all the layers comprising a charge generating material (CGM) and a charge transport material (CTM).

The single layer is formed by coating and drying a mixture consisting of a binder resin dissolved in a solvent and a photosensitive composition comprising a titanylphthalocyanine compound. The dioxolan compound is employed partially or totally in the solvent.

One example of the multilayer is formed by coating and drying a coating composition comprising a charge generating material (titanylphthalocyanine compound) and a coating composition comprising a charge transport material. The dioxolan compound is employed in the coating composition comprising the charge generating material or the coating composition comprising the charge transfer material. Though the dioxolan compound is not incorporated in the coating composition comprising the charge generating material but is incorporated only in the coating composition comprising a charge transport material, the dioxolan compound is incorporated in the layer comprising the charge generating material through the diffusion.

In order to improve coating properties, silicone oil is also preferably incorporated in a coating composition for the photoreceptor.

As the silicone oils, methylphenylsilicone oil and dimethylsilicone oil are preferred and the content in solid components of the layer incorporated is preferably between 10 and 1,000 ppm.

As electrically conductive supports to support the above-mentioned photosensitive layer, there may be employed metal plate and drum composed of aluminum, nickel, etc., plastic film sputtered with aluminum, tin oxide, indium oxide, etc., or paper, plastic film and drum coated with an electrically conductive material.

When a sublayer is provided between an electrically conductive support and photosensitive layer, a resin based sublayer utilizing a polyamide series compound such as nylon, etc. or so-called ceramic based sublayer (hardening sublayer) utilizing an organic metal compound and a silane coupling agent is preferably employed.

The photosensitive layer comprising an organic photoconductive layer particularly having a function-separating type comprising a charge transport material and a charge generating material is preferably formed by coating particularly these charge transport layer and charge generating layer independently as an independent layer in the multilayer form.

The charge generating layer is formed by dispersing the charge generating material into a binder resin, if desired.

Furthermore, binder resins capable of being employed for the charge generating layer include, for example, polystyrene resins, polyethylene resins, polypropirene resins, polyacryl resins, polymethacryl resins, polyvinyl chloride resins, polyvinyl acetate resins, polyvinylbutyral resins, polyepoxy resins, polyurethane resins, polyphenol resins, polyester resins, polyalkyd resins, polycarbonate resins, polysilicone resins, polymelamine resins, and copolymer resins comprising at least two of recurring units in those resins such as, for example, vinyl chloride-vinyl acetate copolymer resins, vinyl chloride-vinyl acetate-maleic anhydride copolymer resins, or organic polymer semiconductors such as poly-N-vinylcarbazole.

The charge transport layer is composed of a charge transport material alone or it together with a binder resin. Charge transport materials include, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazin derivatives, aminostilbene derivatives, triaryamine derivatives, phenylediamine derivatives, benzidine derivatives, poly-N-vinylcarbazole , poly-1-vinylpyrene, poly-9-vinylanthracene, etc. Furthermore, these may be employed individually or in combination.

Binder resins capable of being employed in the charge transport layer include, for example, polycarbonate resins, polyacrylate resins, polyester resins, polystyrene resins, styrene-acrylonitrile copolymer resins, polymethacrylic acid ester resins, styrene-methacrylic acid ester copolymer resins, etc.

In order to minimize the fatigue degradation due to the repeated use and improve the durability, to any of layers of the photoreceptor may be added a suitable amount of additives known in the art, if desired, such as antioxidants, electron accepting materials, surface modifying agents, plasticizers, ambient dependence improving agents, spectral sensitivity correcting dyes, etc.

In order to improve the durability, a non-photosensitive layer such as a protective layer may be provided besides the photosensitive layer, if desired, and by adding the above-mentioned charge transport material to this layer, the photoreceptor may be composed of a so-called composite layer type charge transport layer.

There are various methods for coating these photosensitive layers. Of them, particularly, a slide-hopper type coating apparatus which is one type of circular volume regulating coating methods (apparatuses) is preferably employed for the coating. These technologies are disclosed in Japanese Patent Publication Open to Public Inspection Nos. 58-189061 and 7-128023, and Japanese Patent Application No. 7-162021, etc.

This coating method is described below.

(Coating Apparatus)

FIG. 1 is a schematic sectional view of a coating apparatus which can be employed in the present invention. FIG. 1 shows cylindrical members 1A and 1B piled up vertically along a center line Y and a slide hopper type coating apparatus 3 which coats successively a coating composition 2 for a photosensitive layer on the cylindrical members 1A and 1B.

As surrounding the above-mentioned cylindrical member 1A, a coating composition slide surface 4 for the coating composition 2 is formed and an arrangement is made so as to coat successively the coating composition 2 supplied to the coating composition slide surface 4 on the above-mentioned cylindrical member 1A. As the coating method, the above-mentioned coating apparatus 3 is fixed, and as elevating the above-mentioned cylindrical member 1A in the arrow direction along the center line Y, the coating is carried out from the upper extreme end. In order to supply the coating composition 2 to the coating composition slide surface 4 of the above-mentioned coating apparatus 3, from a coating composition tank 5 provided in the exterior, the coating composition 2 is supplied by connecting a composition transport pump 6-1, composition transport tubing 6-1' and a coating composition supplying section 6A with the above-mentioned circular volume regulating type coating apparatus 3.

The supplied coating composition 2 is then conveyed to a circular coating composition dividing chamber 7 formed in the above-mentioned cylindrical coating apparatus 3; the coating composition 2 is continuously supplied, via coating composition distribution slit 8, to the above-mentioned coating composition slide surface 4 from a outlet 9 for the flowing coating composition, and the coating composition 2 is coated on the whole circumferential surface of the above-mentioned cylindrical member 1A. The reference 12 is a composition collecting section which collect the coating composition 2 fallen from the above-mentioned coating composition slide surface 4.

Figure 2:
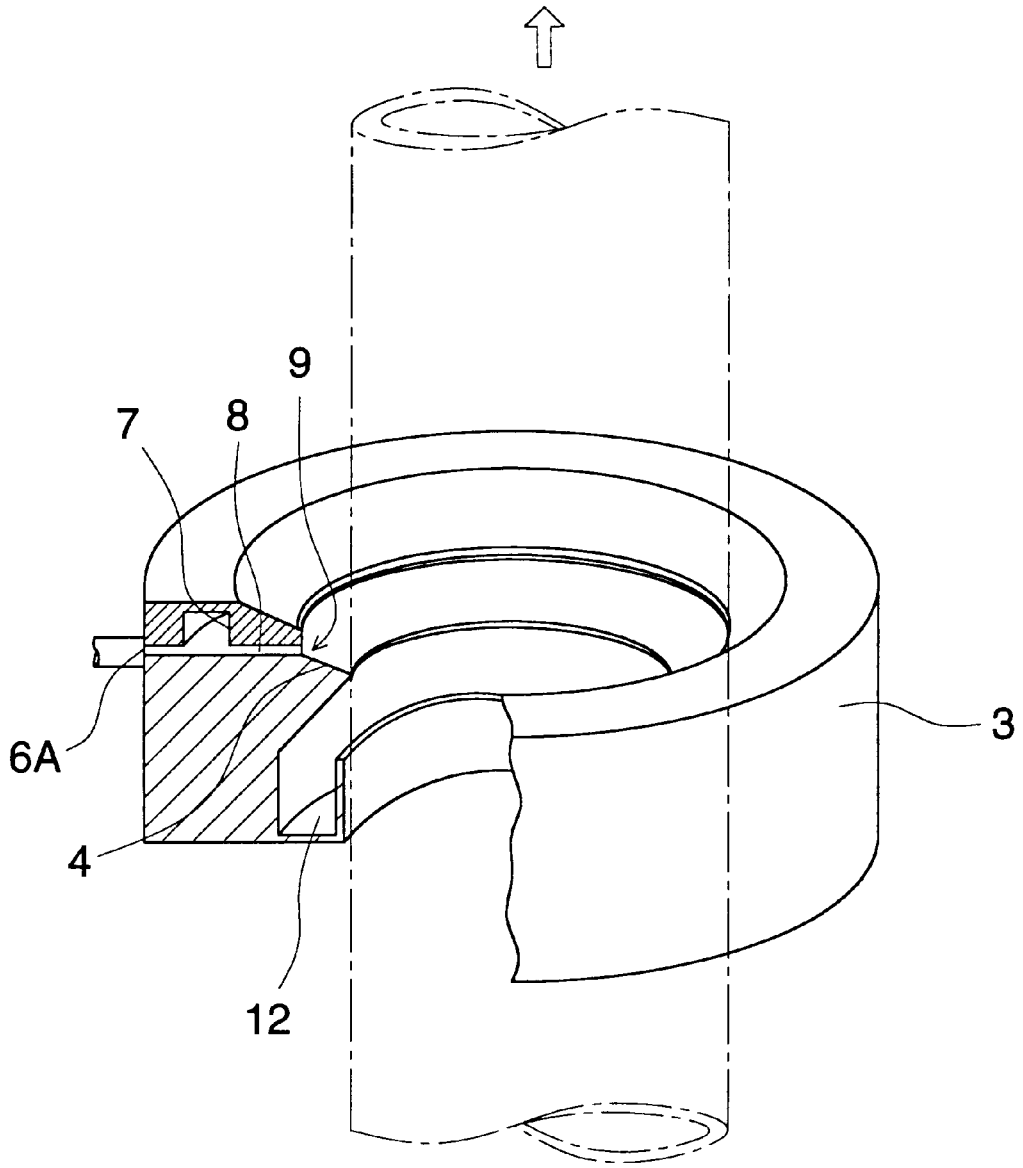
FIG. 2 is a perspective view of a slide hopper type coating apparatus employed in the present invention.

FIG. 2 is a perspective view showing of the above-mentioned slide hopper type coating apparatus partly cut shown in FIG. 1.

Figure 3:
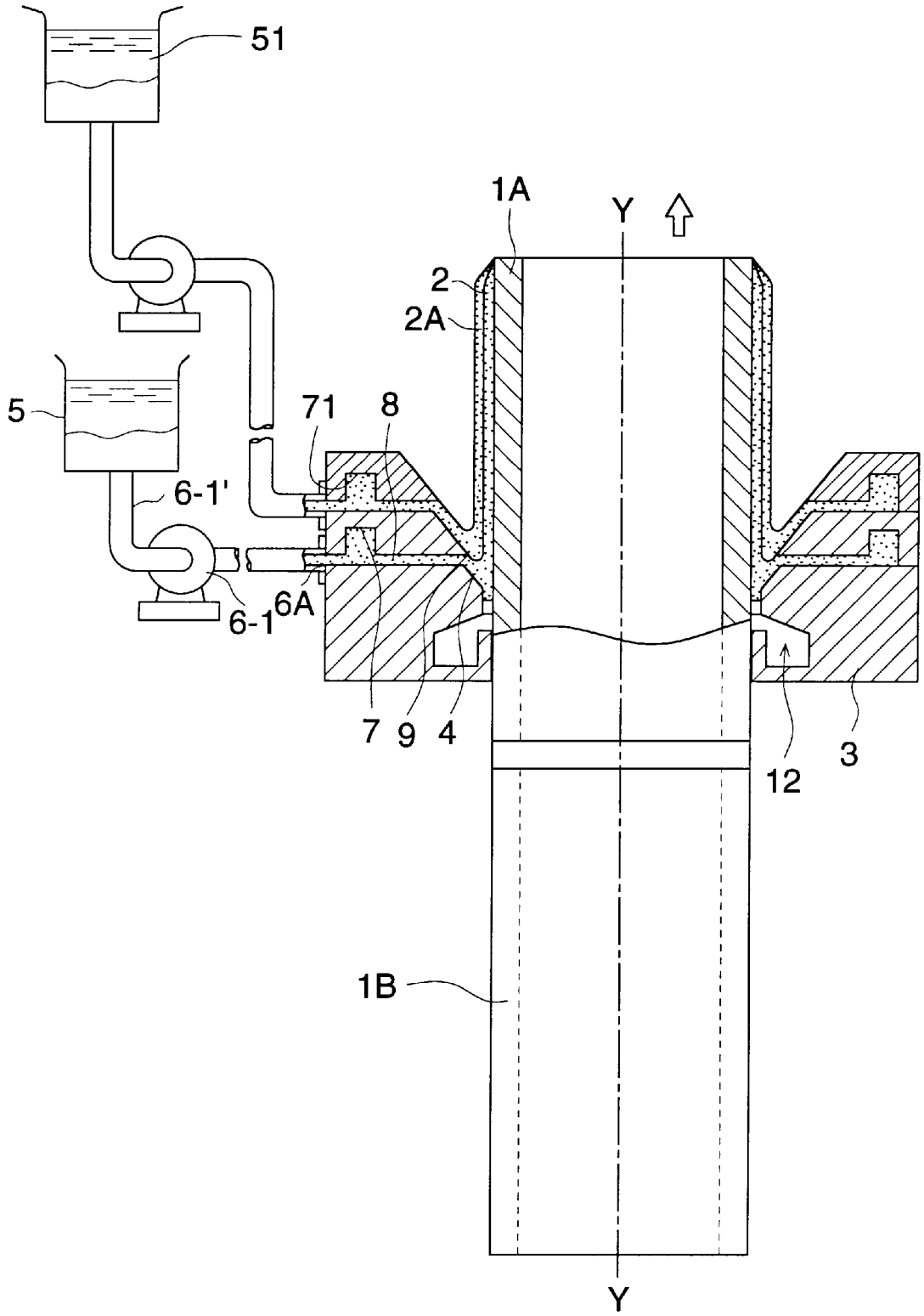
FIG. 3 is a schematic sectional view of a coating apparatus employing a simultaneous multilayer coating method.

FIG. 3 is a schematic sectional view of a coating apparatus showing a simultaneous multilayer coating method for coating simultaneously coating compositions to be a photoreceptor in multilayer form on cylindrical members 1A and 1B by employing the slide hopper type coating apparatus 3.

FIG. 3 shows cylindrical members 1A and 1B piled up vertically along a center line Y and a circular coating apparatus 3 which coats successively a coating composition 2 for a photosensitive layer on the cylindrical members 1A and 1B. As shown in FIG. 3, as surrounding the above-mentioned cylindrical member 1A, a coating composition slide surface 4 for the coating compositions 2 and 2A is formed and an arrangement is made so as to coat successively the coating compositions 2 and 2A supplied to the coating composition slide surface 4 on the above-mentioned cylindrical member 1A. As the coating method, the above-mentioned circular coating apparatus 3 is fixed and as elevating the cylindrical member 1A in the arrow direction along the center line Y, the coating is carried out from the upper extreme end. In order to supply the coating compositions 2 and 2A to the coating composition slide surface 4 of the above-mentioned coating apparatus 3, the coating compositions are conveyed from a coating composition tank 5 provided in the exterior to a coating composition distributing chamber 7 through a coating composition transport pump 6-1, a coating composition transport tubing 6-1' and a coating composition supplying section 6A.

The conveyance of the coating composition from a coating composition tank 51 to the coating composition distributing chamber 71 is carried out in the same manner.

The above-mentioned coating composition 2 is then supplied to the circular coating composition distributing chamber 7 formed in the coating apparatus 3, and the above-mentioned coating composition 2A is supplied to the coating composition distributing chamber 71. The resulting coating composition 2 is continuously supplied to the coating composition slide surface 4 through a coating composition distributing slit 8 and an endless coating composition outlet 9 and the coating composition 2 is firstly coated on the whole circumferential surface of the above-mentioned cylindrical member 1A.

Furthermore, the above-mentioned coating composition 2A is supplied to the above-mentioned coating composition distributing chamber 71. The supplied coating composition 2A is continuously supplied onto the surface of the above-mentioned coating composition 2 and the coating composition 2 is firstly coated on the whole circumferential surface of the above-mentioned cylindrical member 1A and the coating composition 2A is then coated on it in multilayer form.

The reference numeral 12 is a coating composition collecting section which collects the coating composition 2 through gravity flow from the above-mentioned coating composition slide surface 4.

Figure 4:
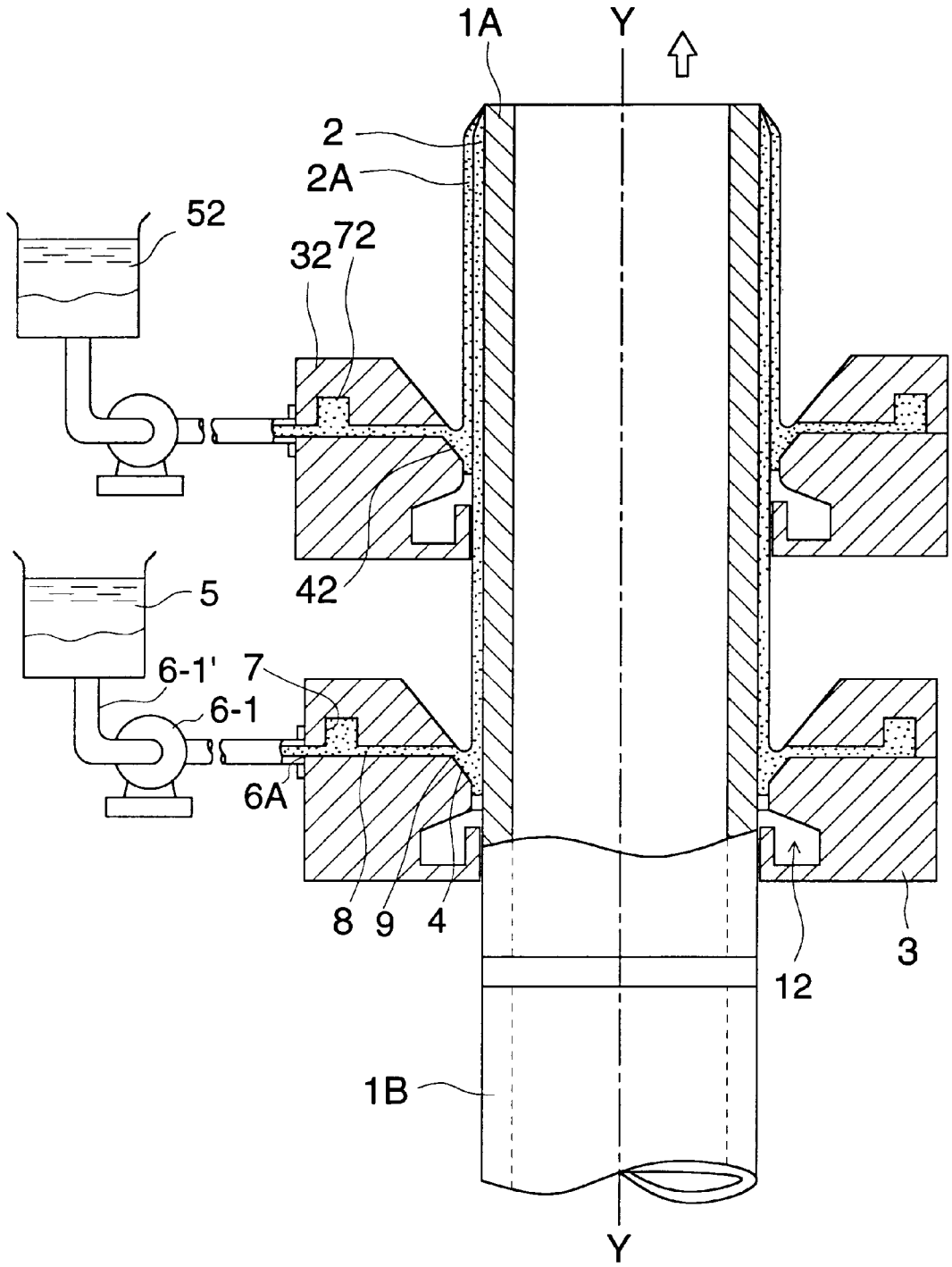
FIG. 4 is a schematic sectional view of a coating apparatus employing a successive multilayer coating method.

FIG. 4 is a vertical view of the coating apparatus 3 employed in the embodiment in the above-mentioned FIG. 1 and a schematic sectional view of the coating apparatus employed in a successive multilayer coating method. This is also an embodiment in which multilayer coating of coating compositions is carried out on cylindrical members 1A and 1B in endless shape as shown in the above-mentioned FIG. 3.

In the same manner as for the above-mentioned FIG. 1, at first, a coating composition 2 which is supplied to the coating composition slide surface 4 is coated onto a cylindrical member 1A. As the coating method, a coating apparatus 3 is fixed and as elevating the above-mentioned cylindrical member 1A in the arrow direction along the center line Y, the coating is carried out from the upper extreme end. In order to supply the coating composition 2 to the coating composition slide surface 4 of the above-mentioned coating apparatus 3, the coating composition is conveyed from a coating composition tank 5 provided in the exterior to a coating composition distributing chamber 7 through a coating composition transport pump 6-1, a coating composition transport tubing 6-1' and a coating composition supplying section 6A (conveyance of the coating composition from a coating composition tank 52 to the coating composition distributing chamber 72 is carried out in the same manner.).

Thus, the coating composition is supplied to the circular coating composition distributing chamber 7 formed in the coating apparatus 3 and is then supplied continuously to the above-mentioned coating composition slide surface 4 through a coating composition distributing slit 8 and an endless coating composition flow outlet. Thus, the coating composition 2 is coated as the first layer onto the whole circumferential surface of the above-mentioned cylindrical mender 1A.

Furthermore, a coating apparatus 32 is provided above the coating apparatus 3.

The cylindrical member 1A coated with the first layer coating composition 2 is elevated in the arrow direction and is approached to the position of a coating composition slide surface 42 of a coating apparatus 32. The coating composition 2A supplied to the coating composition slide surface 42 is successively coated onto the surface of the coating composition 2 coated on the above-mentioned cylindrical member 1A in multilayer coating form. As the coating method, in the same manner as described above, the coating apparatus 32 is fixed, and as elevating the above-mentioned cylindrical member 1A in the arrow direction along the center line Y, the coating is carried out from the upper extreme end.

In order to supply the coating composition 2A to the coating composition slide surface 42 of the above-mentioned circular coating apparatus 32, the coating composition 2A is supplied from a coating composition tank 52 through the coating composition supplying section with a coating composition transport pump which in connected to the coating apparatus 32 (connecting method is the same as that for the above-mentioned coating apparatus 3.). The supplied coating composition 2A is then supplied to a circular coating composition distributing chamber 72 formed in the coating apparatus 32 and is continuously supplied to the above-mentioned coating composition slide surface 42 through a coating composition distributing slit and an endless coating composition flow outlet. Thus, the coating composition 2A is coated onto the whole circumferential surface of the coating composition 2 coated on the above-mentioned cylindrical member 1A.

The image-forming apparatus which may be employed in the present invention is described below.

(Image-forming Apparatus)

Figure 5:
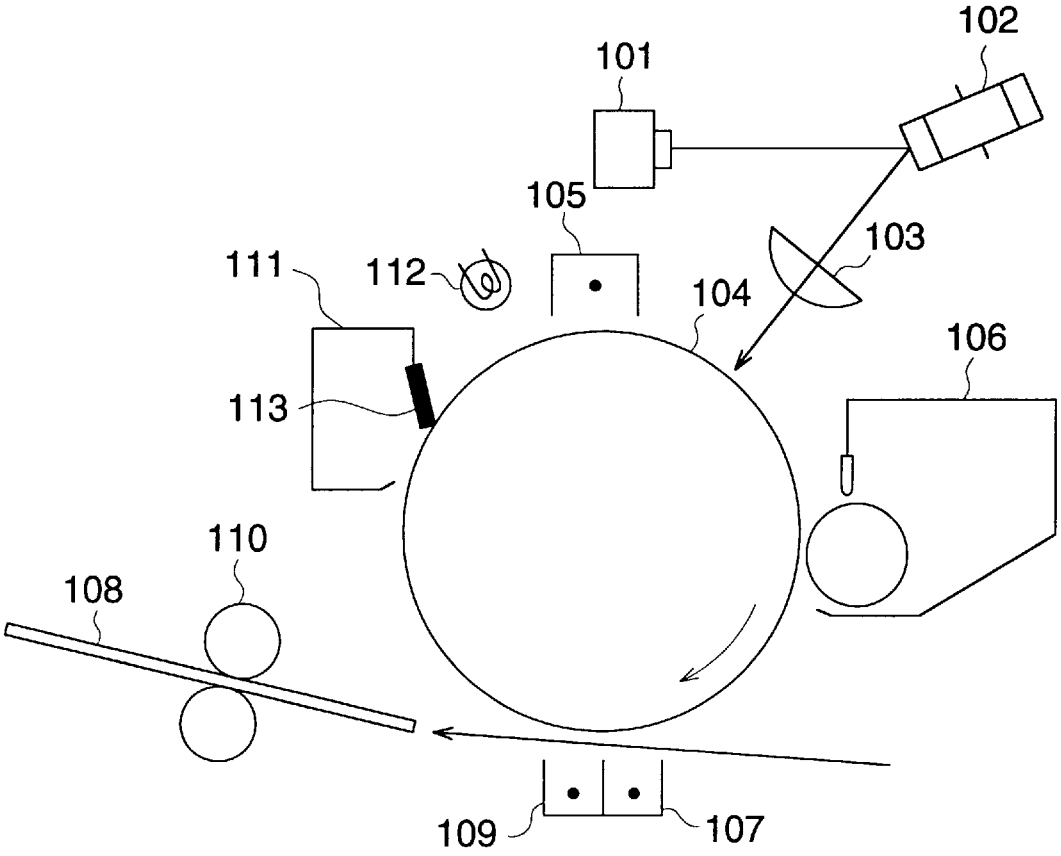
FIG. 5 is a schematic sectional view of an image-forming apparatus employed in the present invention.

In an image-forming apparatus shown in FIG. 5, light from a light source is emitted onto an original document and the reflection light is converted to electric signals at an image reading, though not shown. The image data are transmitted to image writing section composed of 101 to 103. Further, 101 is a exposure light source, 102 is a polygon mirror and 103 is an optical image correcting lens such as Fθ lens, etc.

During image formation, a photoreceptor drum 104 rotating in the arrow direction is charged by a uniform charging device 105. Image exposure is then performed on the charged drum by the above-mentioned image writing section to form an electrostatic latent image, which is then developed by a development device 106. The developed image on the photoreceptor is transferred by a transfer electrode (transfer device) 107 onto a transfer member 108 which is conveyed upon adjusting timing, and the transfer member is separated from the photoreceptor by a separation electrode (separation device) 109 and is conveyed to a fixing device 110.

After separation, the residual toner which is not transferred and remains on the photoreceptor drum 104 is removed by a cleaning device 111 having cleaning brade 113, and the cleaned photoreceptor drum 104 is subjected to exposure from a pre-charging exposure lamp (PCL) 112 and is charged again by the uniform charging device 105.

Further, the above-mentioned transfer member is generally a plain paper sheet and includes widely members to which images may be transferred, such as PET film base for a overhead projector (OHP), etc.

Further, regarding to original information for image formation, besides those mentioned above, image information may be previously stored in image memory such as ROM, floppy disk, etc. and the information in the image memory is taken out and can be output to the image-forming section. Accordingly, as shown in this embodiment, a device which has no image reading section and stores information from computers, etc. is stored in a memory and outputs the stored information to the image-forming section is included in the present invention. As the most general devices, there are ED printers and LBP laser beam printer).

EXAMPLES

The present invention is described in detail with reference to Examples. However, embodiments of the present invention is not limited to those Examples.

Example 1

As an electrically conductive support, was employed an aluminum support subjected to mirror surface treatment having a diameter of 80 mm and a height of 355 mm.

On the above-mentioned support, a sublayer coating composition described below was prepared and coated so as to form a dried layer thickness of 1.0 μm.

1. Sublayer Coating Composition

| | |
|---|---|
| Titanium chelate compound (TC-750, manufactured by Matsumoto Seiyaku Co., Ltd.) | 30 g |
| Silane coupling agent (KBM-503, manufactured by Shin-Etsu Kagaku Kogyo Co., Ltd.) | 17 g |
| 2-Propanol | 150 ml |

On this sublayer, the following photosensitive layer coating composition was prepared by diapason and was coated so as to obtain a dried layer thickness of 0.5 μm.

2. Charge Generating Layer Coating Composition

Figure 6:
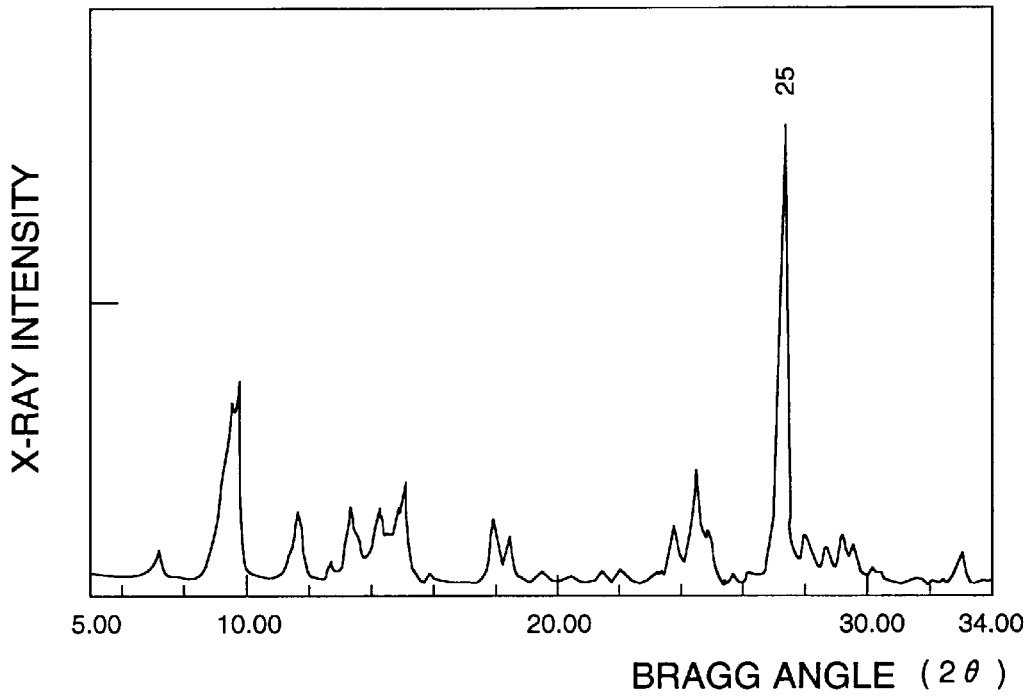
FIG. 6 is a graph showing a peak of X-ray diffraction spectra for Cu—Kα line of Y type titanylphthalocyanine employed in Example 1.

| | |
|---|---|
| Y type titanylphthalocyanine (described in Fig. 6), (described in Japanese Patent Publication Open to Public Inspection No. 64-17066) | 10 g |
| Silicone resin (KR-5240 manufactured by Shin-Etsu Kagaku Kogyo Co., Ltd.) | 10 g |
| t-Butyl acetate | 1,000 ml |

The above-mentioned coating composition was dispersed for 20 hours on a sand mill.

The charge transport layer coating composition mentioned below was prepared and coated on this charge generating layer prior to its drying so as to obtain a dried layer thickness of 23 μm and the resulting coating was dried at 100° C. for one hour to obtain a photoreceptor, while the content of dioxolan No. 1 was 1.5 percent.

3. Charge Transport Layer Coating Composition

| | |
|---|---|
| CTM-3 | 420 g |
| Upiron Z-300 (manufactured by Mitsubishi Chemical Inc..) | 660 g |
| Dioxolan (No. 1) | 2,800 ml |

CTM-3

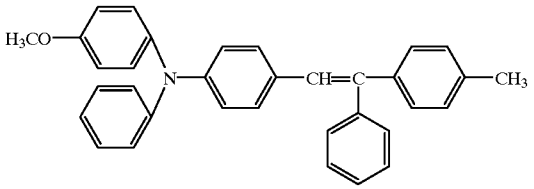

Example 2

A photoreceptor was prepared in the same manner as for Example 1, except that the temperature for drying the charge transport layer was changed from 100° C. to 120° C., while the content of dioxolan No. 1 was 0.01 percent.

Example 3

A photoreceptor was prepared in the same manner as for Example 1, except that the temperature for drying the charge transport layer was changed from 100° C. to 90° C., while the content of dioxolan No. 1 was 3.5 percent.

Example 4

A photoreceptor was prepared in the same manner as for Example 1, except that the solvent for the charge transport layer coating composition was changed from dioxolan No. 1 to No. 2, while the content of dioxolan No. 2 was 1.2 percent.

Example 5

A photoreceptor was prepared in the same manner as for Example 1, except that the charge transport layer coating composition was changed to that shown below; the charge transport layer was coated to obtain a dried layer thickness of 23 μm and was dried at 100° C. for 30 minutes, while the content of dioxolan No. 1 and No. 2 was 1.2 percent, respectively.

Charge Transport Layer Coating Composition

| | |
|---|---|
| CTM-3 | 420 g |
| Upiron Z300 manufactured by Mitsubishi Chemical Inc.) | 660 g |
| Dichloromethane | 2,500 ml |
| Dioxolan (Example Compound No. 1) | 270 ml |
| Dioxolan (Example Compound No. 2) | 30 ml |

Example 6

A photoreceptor was prepared in the same manner as for Example 1, except that as the charge generating layer as the second layer, the charge generating layer coating composition described below was coated so as to obtain a layer thickness of 0.5 μm. At the time, the content of dioxolan No. 1 in the photosensitive layer was 0.3 percent.

Charge Generating Layer Coating Composition

| | |
|---|---|
| Y type titanylphthalocyanine | 10 g |
| Silicone resin (KR-5240, manufactured by Shin-Etsu Kagaku Kogyo Co., Ltd.) | 10 g |
| t-Butylacetate | 900 ml |
| Dioxolan (Example Compound No. 1) | 100 ml |

The above-mentioned coating composition was dispersed for 20 hours on a sand mill.

Example 7

A photoreceptor was prepared in the same way as for Example 1, except that the thickness of the charge transport layer was changed to 35 μm, while the content of dioxolan No. 1 was 2.5 percent.

Example 8

A photoreceptor was prepared in the same way as for Example 1, except that the thickness of the charge transport layer was changed to 15 μm, while the content of dioxolan No. 1 was 1.05 percent.

Example 9

Figure 7:
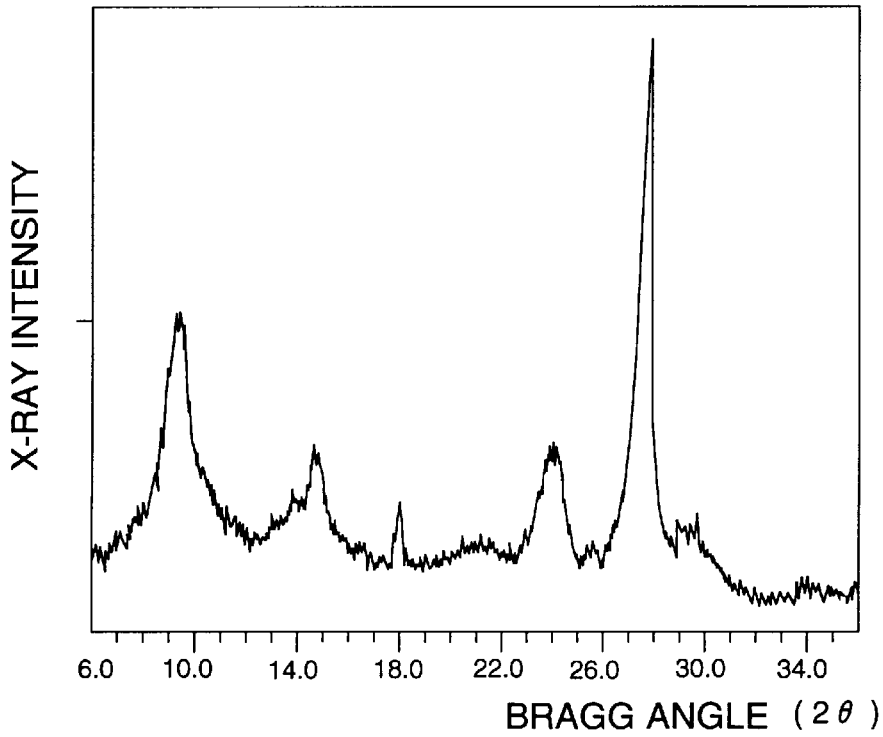
FIG. 7 is a graph showing a peak of X-ray diffraction spectra for Cu—Kα line of Y type titanylphthalocyanine employed in Example 9.

A photoreceptor was prepared in the same manner as for Example 1, except that the carrier generating material was replaced with titanylphthalocyanine shown in FIG. 7, while the content of dioxolan No. 1 was 1.5 percent.

Example 10

Titanylphthalocyanine having a clear peak only at 27.2° was obtained according to the comparative example in Japanese Patent Publication Open to Public Inspection No. 62-67094. A photoreceptor was then prepared in the same manner as for Example 1, except that this crystal compound was employed instead of the carrier generating material in Example 1, while the content of dioxolan No. 1 was 1.5 percent.

Example 11

Figure 8:
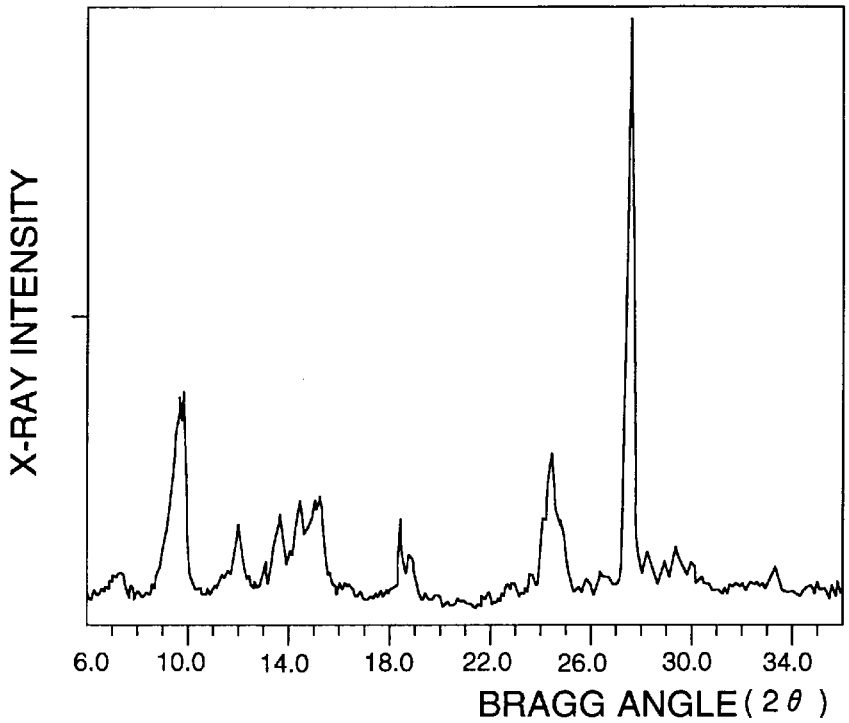
FIG. 8 is a graph showing a peak of X-ray diffraction spectra for Cu—Kα of a titanylphthalocyanine/vanadylphthalocyanine mixed crystal employed in Example 11.

A photoreceptor was prepared in the same manner as for Example 1, except that the carrier generating material was changed to the titanylphthalocyanine/vanadylphthalocyanine mixed crystal shown in FIG. 8, while the content of dioxolan No. 1 was 1.5 percent.

Example 12

Figure 9:
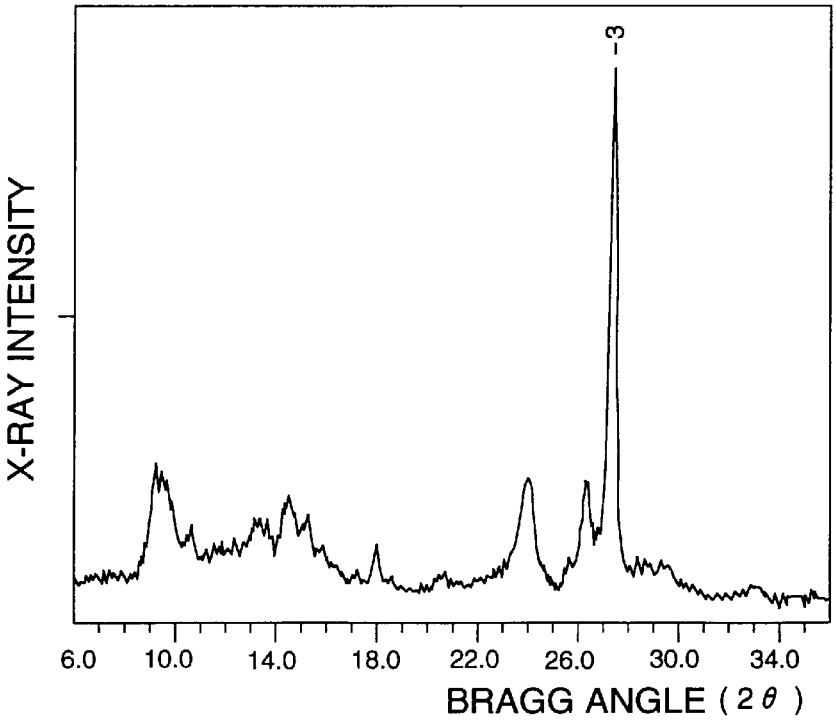
FIG. 9 is a graph showing a peak of X-ray diffraction spectra for Cu—Kα of a titanylphthalocyanine/vanadylphthalocyanine mixed crystal employed in Example 12.

A photoreceptor was prepared in the same manner as for Example 1, except that the carrier generating material was replaced with the titanylphthalocyanine/vanadylphthalocyanine mixed crystal shown in FIG. 9, while the content of dioxolan No. 1 was 1.5 percent.

Comparative Example 1

A photoreceptor was prepared in the same manner as for Example 1, except that the charge transport layer was dried at a temperature of 130° C., while the content of dioxolan No. 1 was 0.0001 percent.

Comparative Example 2

A photoreceptor was prepared in the same manner as for Example 1, except that the charge transport layer was dried at a temperature of 60° C., while the content of dioxolan No. 1 was 12.5 percent.

Comparative Example 3

A photoreceptor was prepared in the same manner as for Example 1, except that the carrier generating material in Example 1 was replaced with an A type titanylphthalocyanine described in Japanese Patent Publication Open to Public Inspection No. 62-67094, while the content of dioxolan No. 1 was 1.5 percent.

Comparative Example 4

A photoreceptor was prepared in the same manner as for Example 1, except that the carrier generating material in Example 1 was replaced with a T type metal free phthalocyanine described in Japanese Patent Publication Open to Public Inspection No. 8-297372, while the content of dioxolan No. 1 was 1.5 percent.

Comparative Example 5

A photoreceptor was prepared in the same manner as for Example 2, except that the carrier generating material in Example 2 was replaced with a phthalocyanine composition composed of titanylphthalocyanine and chloroindiumphthalocyanine having peaks at 7.5° and 27.2° of Bragg angle 2θ obtained according to the production example described in Japanese Patent Publication Open to Public Inspection No. 7-104490, while the content of dioxolan No. 1 was 0.01 percent.

Photoreceptors prepared as mentioned above were employed in a copier, Konica U-BIX 4045, manufactured by Konica Corp. which was modified to a digital exposure system employing a semiconductor laser beam (780 nm) as the light source and the evaluation on characteristics of the photoreceptors were carried out as mentioned below.

1. Electrophotographic Characteristic (VL)

The above-mentioned copier was modified and a surface electrometer was fitted to the position of the development device. VL electric potentials were measured before and after 100,000 repetitions of a process consisting of charging, exposure, discharging under two ambient conditions of high temperature and humidity (30° C., 80%) and low temperature and humidity (10° C. and 20%). Further, VL indicates an electric potential generated at an exposed area at the maximum intensity of exposure light and the lower the value, the more preferred it was.

2. Image Evaluation

After copying 100,000 sheets, formed images were visually evaluated and image defects were inspected. The copying test was conducted in ordinary condition. The image quality was evaluated according to the following criteria.

Evaluation of Image Quality

A: no image defects such as spots and the like are found in images and good for commercial use B: light image defects are partly found but no problem for commercial use C: image defects are clearly found and not suitable for commercial use The results are shown in Table 1.

TABLE 1

| | Image Character istics | Electrophotographic Characteristics | | | |
|---|---|---|---|---|---|
| | | HH(*) | | LL(**) | |
| | | Start | 10 KC | Start | 10 KC |
| Example 1 | A | 30 | 40 | 35 | 40 |
| Example 2 | A | 40 | 65 | 45 | 65 |
| Example 3 | A | 30 | 45 | 35 | 45 |
| Example 4 | A | 30 | 40 | 35 | 40 |
| Example 5 | A | 30 | 40 | 35 | 40 |
| Example 6 | A | 30 | 40 | 35 | 40 |
| Example 7 | A | 25 | 40 | 30 | 35 |
| Example 8 | A | 45 | 55 | 50 | 55 |
| Example 9 | A | 50 | 65 | 55 | 65 |
| Example 10 | A | 75 | 90 | 85 | 100 |
| Example 11 | A | 50 | 60 | 55 | 60 |
| Example 12 | A | 70 | 85 | 75 | 85 |
| Comparative Example 1 | A | 45 | 75 | 70 | 95 |
| Comparative Example 2 | B | 30 | 105 | 40 | 85 |
| Comparative Example 3 | C | 90 | 130 | 95 | 135 |
| Comparative Example 4 | C | 165 | 215 | 170 | 210 |
| Comparative Example 5 | C | 115 | 185 | 135 | 190 |

(*)HH: High temperature and high humidity (30° C., 80%)
(**)LL: Low temperature and low humidity (10° C., 20%)

As can clearly be seen in Table 1, photoreceptors comprising dioxolan of the present invention exhibit excellent electrophotographic characteristics and image characteristics during a copy run of 100,000 sheets. Furthermore, as seen in the Examples, the photoreceptors of the present invention can be manufactured without employing the halogen-atom containing solvents conventionally employed. As a result, problems such as environmental problem, particularly ozone hole generating problem and carcinogenic problem, are not caused.

The invention can provide an electrophotographic photoreceptor which is prepared by employing a solvent which comprises no halogen atoms; is low in toxicity; causes no environmental problems, particularly ozone hole problem and carcinogenic problems; is excellent in multilayer coating properties; exhibits particularly small variation in sensitivity over long-term use, from the initial image formation; is excellent in electric potential properties and image characteristics, and an image-forming apparatus and method of using the same.

I claim:

1. An electrophotographic photoreceptor comprising a photosensitive layer on an electrically conductive support wherein the photosensitive layer contains 0.001 to 10 weight percent of at least one compound selected from the group consisting of the following compound No. 1 through No. 24, and a photosensitive material selected from the group consisting of titanylphthalocyanine and titanylphthalocyanine/vanadylphthalocyanine mixed crystal, Formula (1)

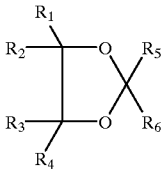

wherein $R_1$ to $R_6$ each independently represents a hydrogen atom or a substituted or unsubstituted alkyl group and at least 2 groups of $R_5$ and $R_6$ or $R_1$ to $R_4$ may join to form a ring.

2. An electrophotographic photoreceptor of claim 1, wherein the photosensitive material is titanylphthalocyanine.

3. An electrophotographic photoreceptor of claim 2, wherein the titanylphthalocyanine has a maximum peak at 27.2°±0.2° of Bragg 2θ for Cu—Kα line.

4. An electrophotographic photoreceptor of claim 2, in which the content of at least one compound selected from the group consisting of dioxolan and dioxolan derivatives is between 0.1 to 5 weight percent.

5. An electrophotographic photoreceptor of claim 2, in which titanylphthalocyanine has a maximum peak at 27.2°±0.2° and a peak at 9.5°±0.2° of Bragg 2θ for Cu—Kα line.

6. An electrophotographic photoreceptor of claim 2, in which titanylphthalocyanine has a maximum peak at 27.2±0.2° and a peak at 9.0°±0.2° of Bragg 2θ for Cu—Kα line.

7. An electrophotographic photoreceptor of claim 1 wherein the photosensitive material is titanylphthalocyanine/vanadylphthalocyanine mixed crystal.

8. An electrophotographic photoreceptor of claim 7, wherein the titanylphthalocyanine/vanadylphthalocyanine mixed crystal has a maximum peak at 27.2°±0.2° of Bragg 2θ for Cu—Kα line.

9. An electrophotographic photoreceptor of claim 7, wherein the titanylphthialocyanine/vanadylphthalocyanine mixed crystal has a maximum peak at 27.2±0.2° and a peak at 9.5±0.2° of Bragg 2θ for Cu—Kα line.

10. An electrophotographic photoreceptor of claim 7, wherein the titanylphthalocyanine/vanadylphthalocyanine mixed crystal has a maximum peak at 27.2±0.2° and a peak at 9.0°±0.2° of Bragg 2θ for Cu—Kα line.

11. An image-forming apparatus employed for forming images on plurality of sheets, comprising a charging means, an image exposure means, a development means, a transfer means, a separation means, and a cleaning means, said image-forming apparatus further comprising the electrophotographic photoreceptor of claim 1.

12. The electrophotographic photoreceptor of claim 1, wherein $R_1$ to $R_6$ each independently represents a hydrogen atom or an alkyl group having 1 to 6 carbon atoms.

13. The electrophotographic photoreceptor of claim 12, wherein $R_1$ to $R_6$ each independently represents a hydrogen atom or an alkyl group having 1 to 4 carbon atoms.

14. The electrophotographic photoreceptor of claim 12, wherein all of $R_1$ to $R_6$ are hydrogen atoms.

15. The electrophotographic photoreceptor of claim 12, wherein the boiling point of the compound is 150° C. or less.

16. The electrophotographic photoreceptor of claim 1, wherein at least one of $R_5$ and $R_6$ is a hydrogen atom.

17. An electrophotographic photoreceptor comprising a photosensitive layer on an electrically conductive support wherein the photosensitive layer contains 0.001 to 10 weight percent of at least one compound selected from the group consisting of dioxolan and dioxolan derivatives selected from the group consisting of following compounds No. 1 through No. 24, No. 1

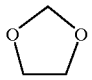

No. 2

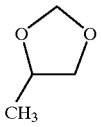

No. 3

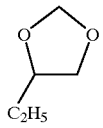

No. 4

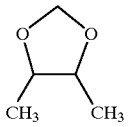

No. 5

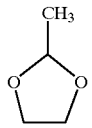

No. 6

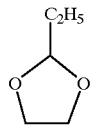

-continued
No. 7
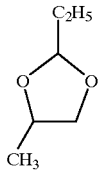
No. 8
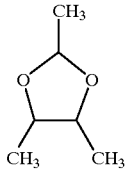
No. 9
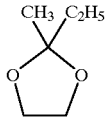
No. 10
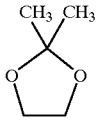
No. 11
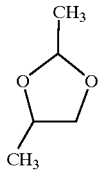
No. 12
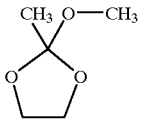
No. 13
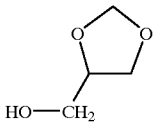
No. 14
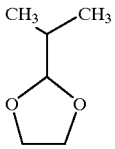
-continued
No. 15
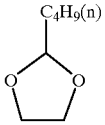
No. 16
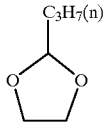
No. 17
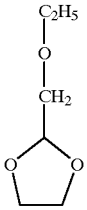
No. 18
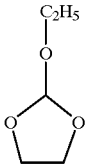
No. 19
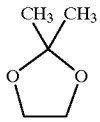
No. 20
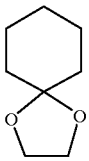
No. 21
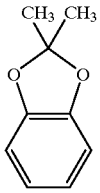
No.22
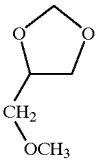

-continued
No.23
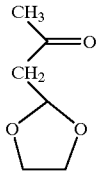
-continued
No.24
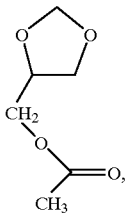
and a photosensitive material selected from the group consisting of titanylphthalocyanine and titanylphthalocyanine/vanadylphthalocyanine mixed crystal.
* * * * *